United States Patent [19]

Mortelmans

[11] 4,232,253

[45] Nov. 4, 1980

[54] DISTORTION CORRECTION IN ELECTROMAGNETIC DEFLECTION YOKES

[75] Inventor: Joost Mortelmans, Campbell, Calif.

[73] Assignee: International Business Machines Corporation, Armonk, N.Y.

[21] Appl. No.: 863,654

[22] Filed: Dec. 23, 1977

[51] Int. Cl.[3] ..... H01J 29/56

[52] U.S. Cl. ..... 315/370; 335/213

[58] Field of Search ..... 315/368, 370; 335/210, 335/213

[56] References Cited

U.S. PATENT DOCUMENTS

| | | | |
|---|---|---|---|
| 3,045,139 | 7/1962 | Lutz | 335/213 |
| 3,398,385 | 8/1968 | Grunwald | 335/210 |
| 3,631,533 | 12/1971 | Torsch | 335/213 |
| 3,671,897 | 6/1972 | Torsch | 335/213 |
| 3,731,241 | 5/1973 | Coupland | 335/213 |
| 3,757,262 | 9/1973 | Over et al. | 335/213 |
| 3,803,444 | 4/1974 | Gerritsen et al. | 315/368 |
| 3,947,793 | 3/1976 | Thompson | 335/210 |
| 3,968,566 | 7/1976 | Schubert | 29/605 |
| 4,117,434 | 9/1978 | Logan | 335/213 |

*Primary Examiner*—Theodore M. Blum

*Attorney, Agent, or Firm*—George E. Roush

[57] ABSTRACT

Distortion due to interaction or cross coupling, frequently termed "cross talk", in magnetic deflection yokes for display tubes is initially corrected by simple networks comprising capacitors and by networks comprising resistor-capacitor combinations connected in the yoke winding circuitry for canceling poles and zeros of the frequency response pattern, and residual distortion is then canceled by rearranging the turns of the winding with respect to the core of an otherwise conventional magnetic deflection yoke to provide a more uniform magnetic field and to avoid resonance in the yoke circuit. The winding is further rearranged in some applications wherein the number of total turns is not integrally divisible by distributing the conductors in an uneven winding arrangement in the same manner but having a difference of a single turn only from the adjacent courses of the winding.

16 Claims, 14 Drawing Figures

DISTORTION CORRECTION IN ELECTROMAGNETIC DEFLECTION YOKES

The invention relates to electromagnetic deflection yokes for cathode ray and like display tubes, and it particularly pertains to modifications of the winding circuitry and the distribution of the winding in the yoke to correct for distortion due to cross coupling or "cross talk" between the windings of the yoke.

Conventional electromagnetic deflection yokes have been and are satisfactory for conventional purposes, but now there is an increased demand for higher resolution in faster systems having more lines and more characters per line, which more critical systems require better yokes.

Present day design calls for yokes having much more attention to reducing the effect of capacitive coupling between the windings for horizontal and vertical deflection. This cross coupling interaction between windings is often termed "cross talk" because it is similar to the problems originally faced in telephone work and the term is applied because of the similarity even though it is not audible distortion.

There are a number of helpful suggestions and winding methods in the prior art among which are the several setforth in the U.S. patents listed below:

| | | | |
|---|---|---|---|
| 3,045,139 | 7/1962 | Lutz | 335/213 |
| 3,631,533 | 12/1971 | Torsch | 335/213 |
| 3,671,897 | 6/1972 | Torsch | 335/213 |
| 3,731,241 | 5/1973 | Coupland | 335/213 |
| 3,757,262 | 9/1973 | Over et al | 335/213 |
| 3,947,793 | 3/1976 | Thompson | 335/210 |
| 3,968,566 | 7/1976 | Schubert | 29/605 |

The patent to Lutz is directed to an electromagnetic deflection yoke assembly that departs from the more-or-less uniform turns distribution of the earlier prior art and the coils have different diameters. The arrangements found in the patent to Coupland and in the patent to Schubert suggest non-uniform winding distribution in the use of gaps in the coil structure but otherwise the distribution is non-uniform as compared to the prior art arrangements only in the distortion of the conductors themselves in the fabrication of the coils, which problems have no particular relationship to magnetic field distortion.

The patents to Torsch are directed to an arrangement of coils and to a core structure for Cathode Ray Tubes (CRT) having triad phosphor color patterns. The arrangements are for therefore directed to beam convergence problems and are to some extent directed to arrangements of non-uniform turns distribution for warping the resultant electric field but not for maintaining uniformity thereof.

Somewhat similarly the patent to Over and Thompson and the patent to Thompson are directed to torroidal winding and core structure therefor wherein a "fly-back" return run conductor places the arrangements in the catagory of non-uniform turns distribution. However, these arrangements otherwise are merely different and avoiding distortion by confining the difference externally of the yoke.

Thus the teaching in these patents has not brought the art to the novel structure according to the invention as will be set forth in the succeeding paragraph. Also the prior art appears to be silent as to the novel deflection circuitry also to be set forth hereinafter.

The objects indirectly referred to hereinbefore and those that will appear as the specification progresses are attained first by altering the circuitry to compensate for reactances which establish undesirable impedances at poles and zeros of the frequency response curves and second by redistributing the conductors in the yoke winding coils in a progressive manner whereby a substantially pure inductance is presented to the circuitry and the poles and zeros are likewise reduced.

By adding a pair of capacitors and/or a capacitor and a resistor network to the influence winding circuit with the components having values related to the cross coupling stray capacitance between the windings of the yoke, a large portion of the distortion is eliminated.

Residual distortion is substantially eliminated by rearranging the individual turns of the coils to provide a more completely uniformed magnetic deflection field and to present a substantially pure inductance in the circuit whereby poles and zeros are substantially eliminated.

The number of turns in the coils of a deflection yoke are not changed by the invention, but the individual turns are redistributed to achieve the desired effect. Thus standard tables of ampere-turns for the particular yoke and/or magnetic deflection desired are still applicable; the individual turns are distributed differently according to the invention.

Briefly each winding is divided into two coils and each coil is further quite frequently divided into a multiple of courses. A first course comprising a single turn is then laid to encompass a central pole for establishing the magnetic field. Thereafter a second course comprising a plurality of turns is laid about a pair of magnetic poles along side the central pole, that second course of turns encompassing all three poles. A multiple of turns comprising a third course are then laid about the next pair of pole encompassing the former pole and finally the remainder of the turns forming a final course are laid to encompass two further poles; all of the aforesaid courses being in service in the complete coil. In the event that the number of turns is not integrally divisible, that is, there is a non-integer number of turns to be accommodated, the procedure is followed as before except that a difference of one turn for each course of the winding is permitted with a difference of but one turn between the number of turns in adjacent courses. This difference in the number of turns may be +1 or −1 turn.

In order that the practical advantages of the invention obtain in practice specific embodiments thereof, given by way of examples only, are described hereinafter with reference to the accompanying drawing, forming a part of the specification, and in which.

Cross coupling in electromagnetic deflection yokes for CRT displays has become more serious with the advent of faster sweep and higher resolution involving more lines and more characters per line to the point where the horizontal deflection wave may affect the vertical deflection wave up to a 25% distortion. This raster distortion is also accompanied by a local defocusing at the peak of the modulation in height. Thus far the vertical deflection wave does not affect or influence the horizontal wave to any great extent, however, the principles for correcting distortion according to the invention are equally applicable to both of the deflection systems.

Figure 1:
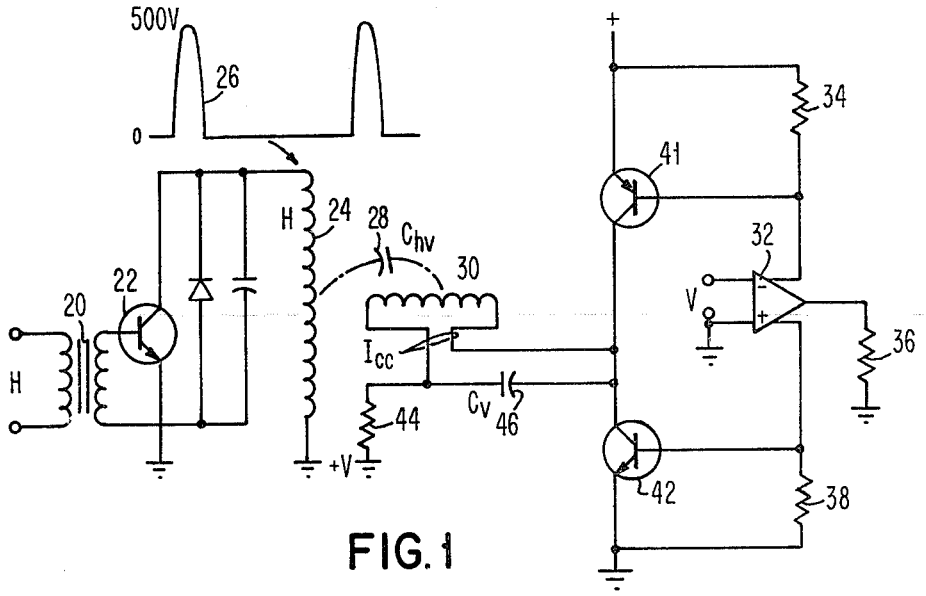
FIG. 1 is a partial schematic diagram of a typical electromagnetic deflection circuit.

The essential components of a magnetic deflection circuit are shown in schematic diagram of FIG. 1. Those skilled in the art will recognize the circuitry and will be able to apply the teachings of the invention to other circuits as well. A horizontal deflection wave is applied through a transformer 20 to a driver transistor 22 for a the horizontal deflection winding 24 which conventionally comprises two coils connected in parallel and mounted in a yoke, preferably a yoke having an electromagnetic core structure for increasing the magnetic field deffect. The voltage across the inductor 24 is graphically represented by the curve 26 which illustrates the rise and similar decrease of voltage (for example from zero to 500 volts) in a very short time. Fast horizontal retrace for such a deflection wave generates large voltage spikes at the horizontal section of the yoke which is a principle cause of raster distortion in the vertical direction. The distortion is caused by the cross coupling current passing through the stray capacitance, represented schematically by a symbol for a capacitor 28, to the vertical deflection winding 30 which usually comprises two coils connected in series.

A vertical deflection wave is applied to a differential applifier circuit 32 having the output terminals connected to three resistors 34, 36 and 38 proportioned to provide equal drive by the output transistors 41 and 42. More detail regarding this driver circuit will be found in the IBM Technical Disclosure Bulletin Vol. 20 No. 3 for August 1977 at pp. 1206–9. The vertical winding 30 comprising two deflection coils connected in series having one terminal connected to the junction between the collector electrodes of the transistors 41 and 42 and the other terminal connected to fixed reference potential, shown here as ground, through a small current sensing resistor 44. The other terminal of the vertical deflection winding circuit is also grounded insofar as the cross coupling frequency is concerned through a vertical deflection circuit tuning capacitor 46. The series resonant circuit, responsible for the cross coupling, comprises the two coils of the vertical winding in parallel (because the capacitor 46 is effectively a short circuit from end to end) as the inductor ($L_{vp}$) and the capacitance ($C_{hv}$) between the horizontal and vertical windings 24, 30 respectively represented as that of a discrete capacitor 28. The damping resistance is the high frequency resistance of the vertical coils which due to skin effect, proximity effect and core losses, can easily be 50 times the d.c. value.

Figure 2:
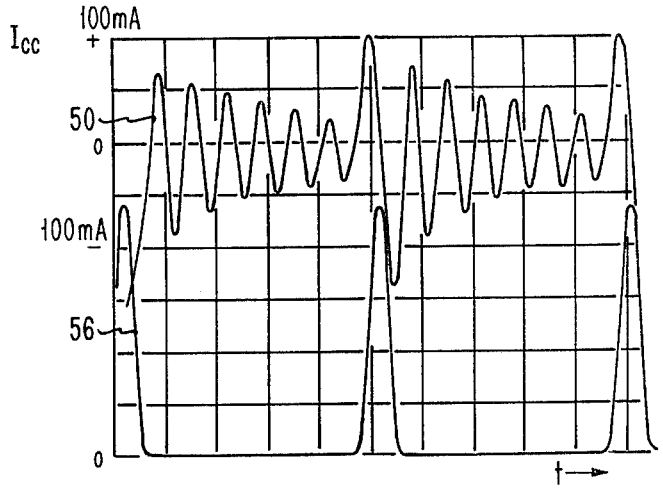
FIG. 2 is a graphical representation of typical flyback pulses and cross coupling current encountered in a typical electromagnetic deflection circuit.
Figure 3A:
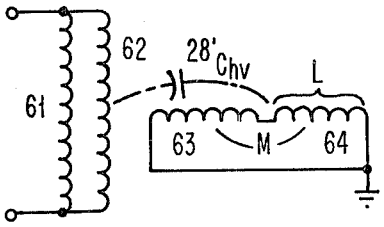
FIGS. 3A and 3B are schematic diagrams of equivalent electric circuitry of such typical electromagnetic deflection yokes.
Figure 3B:
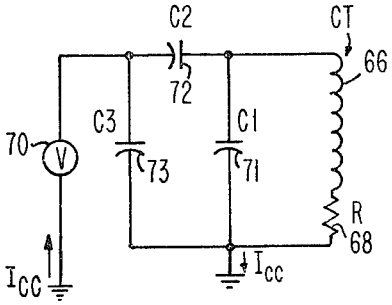

In most instances the cross coupling current can be displayed on an oscilloscope by clipping a current probe across the leads of the vertical deflection winding. Such a common mode current wave form as obtained in an actual test is graphically represented in FIG. 2. This curve 50 shows a striking resemblance to the raster distortion; the horizontal deflection wave 56 is shown in the proper time relationship. In principle, this cross coupling current does not induce a magnetic field, but due to internal resonances is responsible for an unequal current distribution in the coils of the winding making up the vertical section of the yoke. This also accounts for the defocusing effect because the uniformity of the field in the yoke is not maintained and the beam is subjected to a defocusing field gradient. FIGS. 3A and 3B illustrate equivalent circuits for the hereinbefore described circuit. Both horizontal and vertical windings 61–62 and 63–64 respectively each comprise two coils each of which spans substantially 180° inside the core. The horizontal coils are connected in parallel to reduce the flyback voltage and the vertical deflection coils are connected in series to reduce the current required for deflection. In FIG. 3A the capacitor 28' illustrates the capacitive coupling generally. This capacitive coupling is divisible analytically into two components. One such component is considered as a capacitor terminating mostly near the center of the vertical deflection winding and is represented in FIG. 3B by a capacitor 72. The other such component is considered as a capacitor terminating mostly near the terminals of the same winding and is represented by a capacitor 73. The parasitic capacitance of the vertical deflection winding is represented by a capacitor 71. The value of the tuning capacitor 71 is $$C_2=(\tfrac{1}{2}\pi)[(Chv/L_{vp})(1/f_p^2-1/f_n^2)]^{-\frac{1}{2}} \quad (1)$$

Where $f_p$ is the series resonant frequency of the circuit at which the pole of the transfer function of the current Icc occurs; and $f_n$ is the parallel resonant frequency at which the null is located. The resistor 68 represents the high frequency resistance of the winding. The value of the resistor 68 is $$R=C_2^2/I_{cc}f_p(C_1+C_2)^2 \quad (2)$$

At the cross coupling frequency, the terminals of the vertical winding are essentially shorted and the inductance that determines the cross coupling frequency is $$L_{vp}=(L/2)-(M/2)=(L_v/4)-M \quad (3)$$

Where

L is the inductance of one (single) coil;

$L_v$ is the inductance of the vertical winding $=2L+2M$ and

M is the mutual inductance between the two coils of the vertical winding.

The corresponding coupling coefficient is only 25% or 0.25 because the two coils are separated at opposite sides of the yoke. This in turn results in the ratio $L_v/L_{vp}=6.67$. The latter value has been confirmed within +5% and −10% in the yokes tested.

The values of the series capacitor 72 and the shunt capacitor 73 are $$C_2=(\tfrac{1}{2}\pi)[(Chv/L_{vp})(1/f_p^2-1/f_n^2)]^{-\frac{1}{2}} \quad (4)$$

and $$C_3=C_{hv}-C_2 \quad (5)$$

Figure 4:
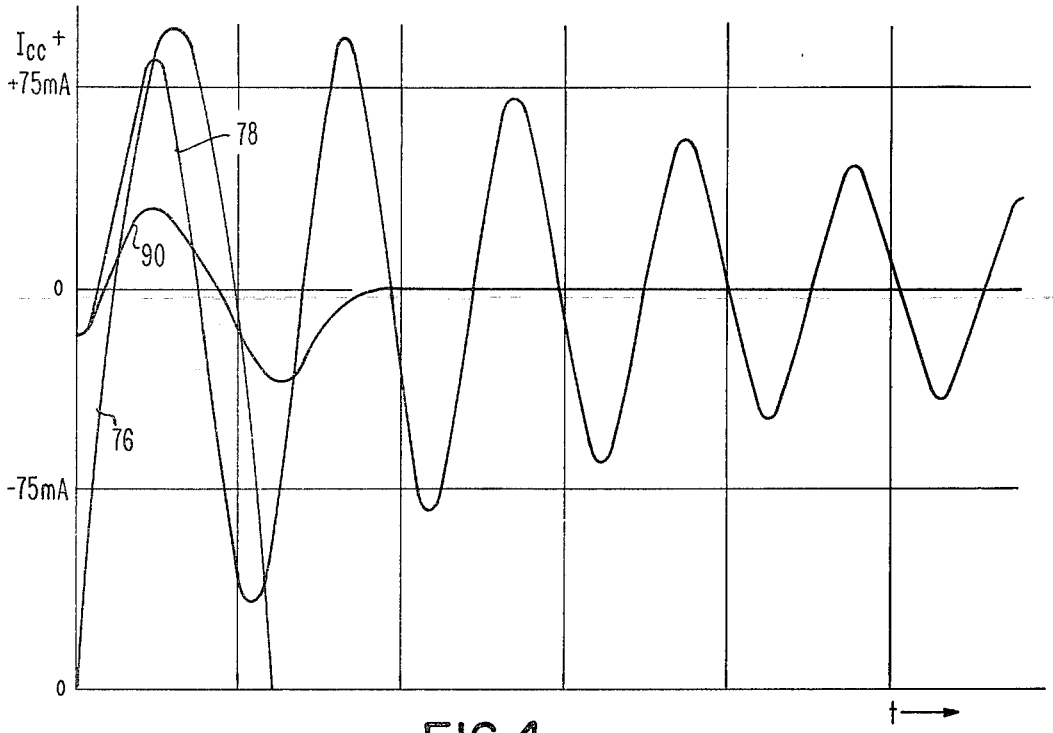
FIG. 4 is a graphical representation of cross coupling current in an equivalent circuit.
Figure 5:
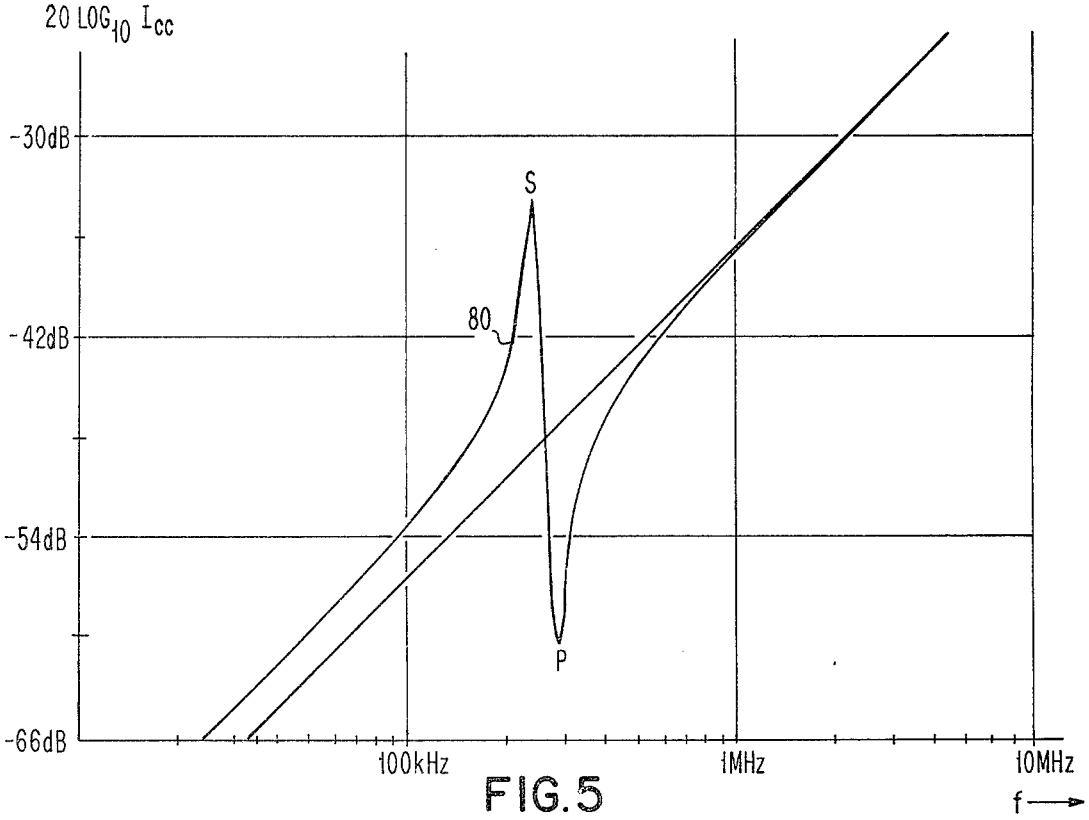
FIG. 5 is a frequency response diagram of cross coupling current.

FIG. 4 shows the results of a calculation of the cross coupling current 78 when a 500 volt flyback pulse 76 is applied to the equivalent circuit. (Ignore curve 90 at this time.) This result correlates closely to the impulse reponse of that network. The frequency response of cross coupling current, on the other hand, is represented graphically by a curve 80 in FIG. 5. The capacitor 73 (FIG. 3B.) causes a pole at infinity and the general 20 db/dec slope of the curve. Another pole is created by the series resonance of the circuit at the frequency $f_p$.

$$f_n=\tfrac{1}{2}\pi[L_{\partial p}(C_1+C_2)]^{-\frac{1}{2}} \quad (6)$$

The zero occurs because of the parallel resonance at the frequency $f_n$ involving all components.

$$f_n=\tfrac{1}{2}[L_{vp}(C_1+\frac{C_2C_3}{C_2+C_3})]^{-\frac{1}{2}} \quad (7)$$

The two frequencies differ because the capacitor 73 is a part of the parallel resonant circuit only.

Figure 6:
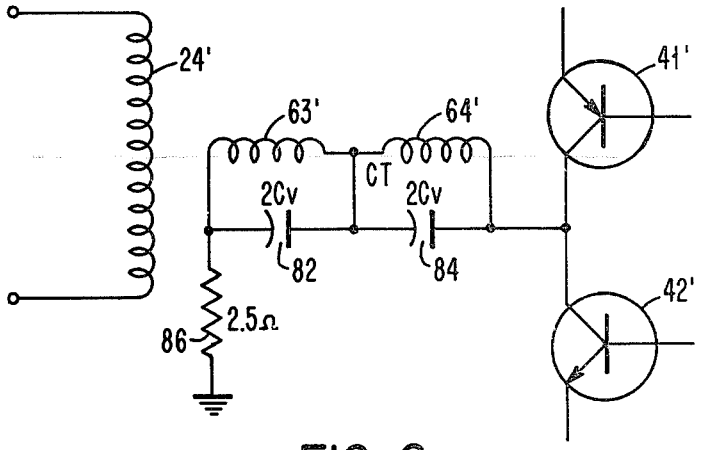
FIG. 6 is a schematic diagram of cross coupling compensation according to the invention.

One method for compensating for cross coupling distortion is to make the frequency $f_p$ equal to the frequency $f_n$ so that the pole and zero cancel each other. This can be accomplished by making the value of the capacitor 73 very large. Unfortunately the junction point of the capacitor 72 and 73 is distributed and usually not available as it is near the interior of the horizontal winding. However, by making the capacitor 71 very large, essentially the same pole-zero cancellation is obtained. Separate capacitors 82 and 84 are connected across the vertical deflection winding 63' and 64' using the center tap. The values of each of the capacitors 82 and 84 is twice the value of the capacitor 46 (FIG. 2). Such an arrangement is illustrated in FIG. 6.

Figure 7A:
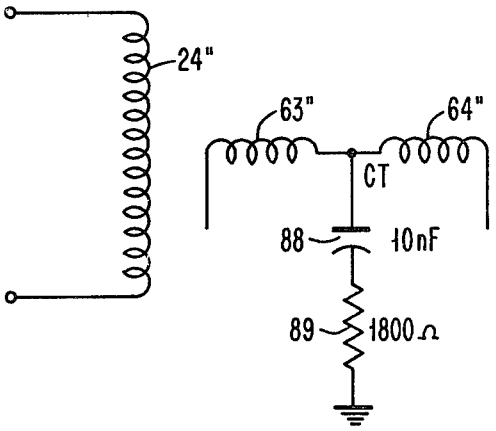
FIGS. 7A and 7B are partial schematic diagrams of cross coupling compensating circuitry according to a different approach in accordance with the invention.
Figure 7B:
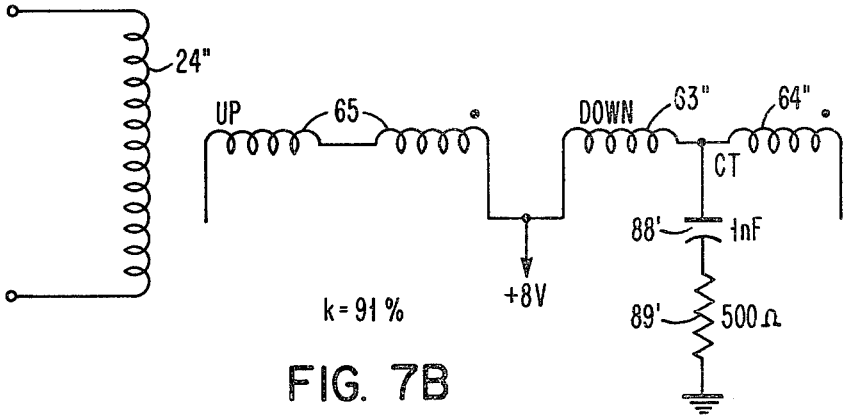
Figure 8:
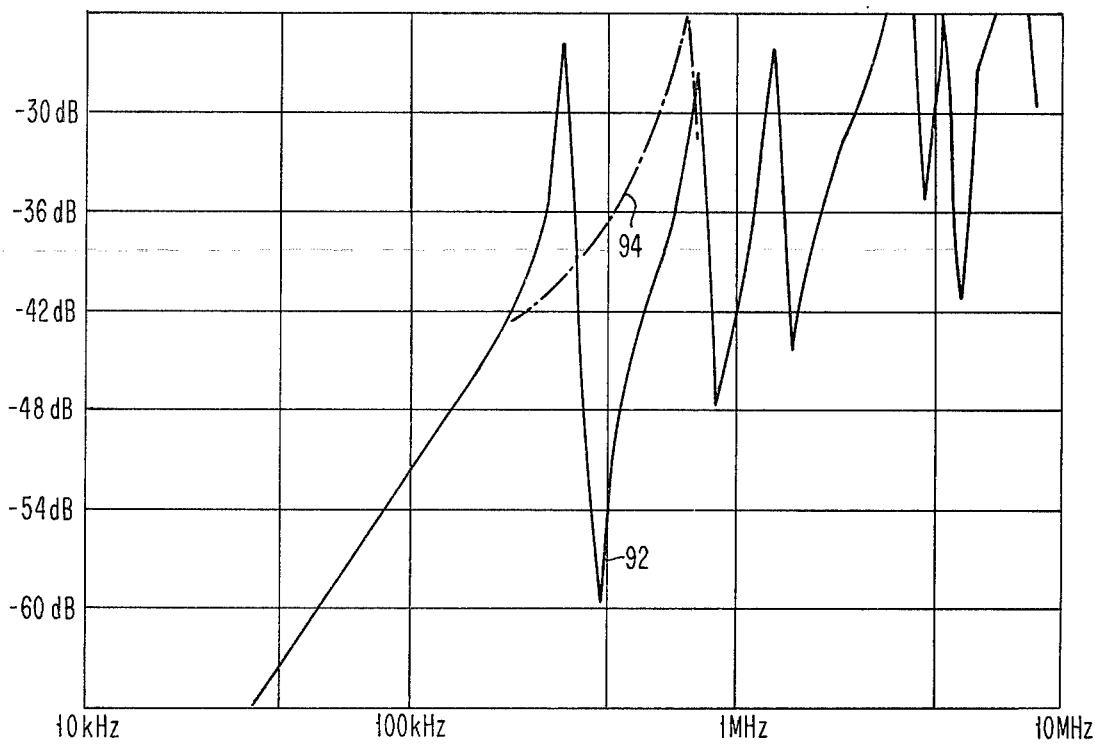
FIG. 8 is a graphical representation of typical cross coupling current against frequency response of electromagnetic deflection yokes in accordance with the invention.
Figure 9:
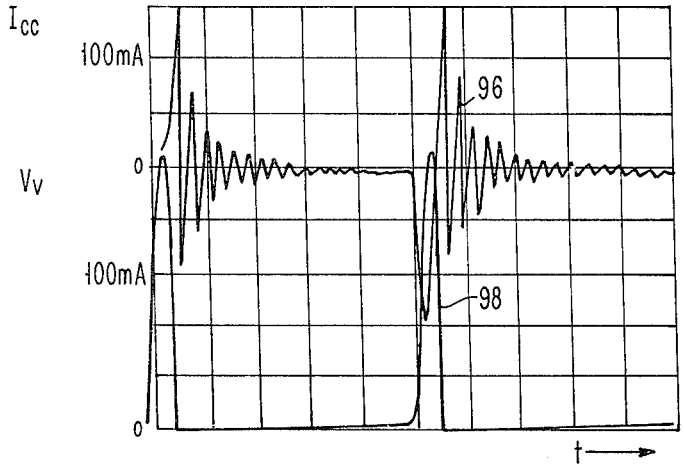
FIG. 9 is a graphical representation of curves obtained on the oscilloscope illustrating cross coupling current with compensation according to the invention.

Another method according to the invention which is as effective as the previous one but which works better with small vertical inductances is shown in FIGS. 7A and 7B. A network comprising a series connected capacitor 88 and resistor 89 is connected between the two coils as shown in FIG. 7A and between the center tap of one coil as shown in FIG. 7B. The effect of the R-C network in this case depends on the relatively tight, on the order of 91%, coupling between the section 65 and the section 63''-64'' of the vertical winding coils. The value of the capacitor 88' and the resistor 89' are different in the latter case, of course. A graphical representation of the results obtained with the circuit arrangement of FIG. 7A is shown by the curve 90 superimposed on the curves of FIG. 4. The values of the capacitor and the resistor are chosen experimentally for optimal correction of cross coupling current. In FIG. 7A, a 10 nanofarad capacitor and an 1800 ohm resistor are used whereas in FIG. 7B a one nanofarad capacitor and a 500 ohm resistor are used. These values represent the critical damping values of this third order system. FIG. 8 is a graphical representation of the cross coupling current frequency response with a curve 92 showing the response without a correcting network and curve 94 with the correcting network in place. FIG. 9 is a graphical representation of an oscilloscopic picture of cross coupling current in curve 96 with a drive pulse curve 98 for reference. The reduction of cross coupling current can be obtained by comparing the curve 96 with the curve 50 in FIG. 2. These representations are to the same scale.

The remaining cross coupling distortion is correctable by laying the conductors of the coils of the windings in a manner different from the conventional coils. The total number of turns to be laid according to the invention remains substantially the same; it is merely the distribution of the conductors in the core that is different.

According to the invention the turns of the coils are distributed in a different manner from the conventional winding. Almost invariably the number of turns to be wound is obtained from a readily available table of ampere-turns for the desired inductance.

Figure 10:
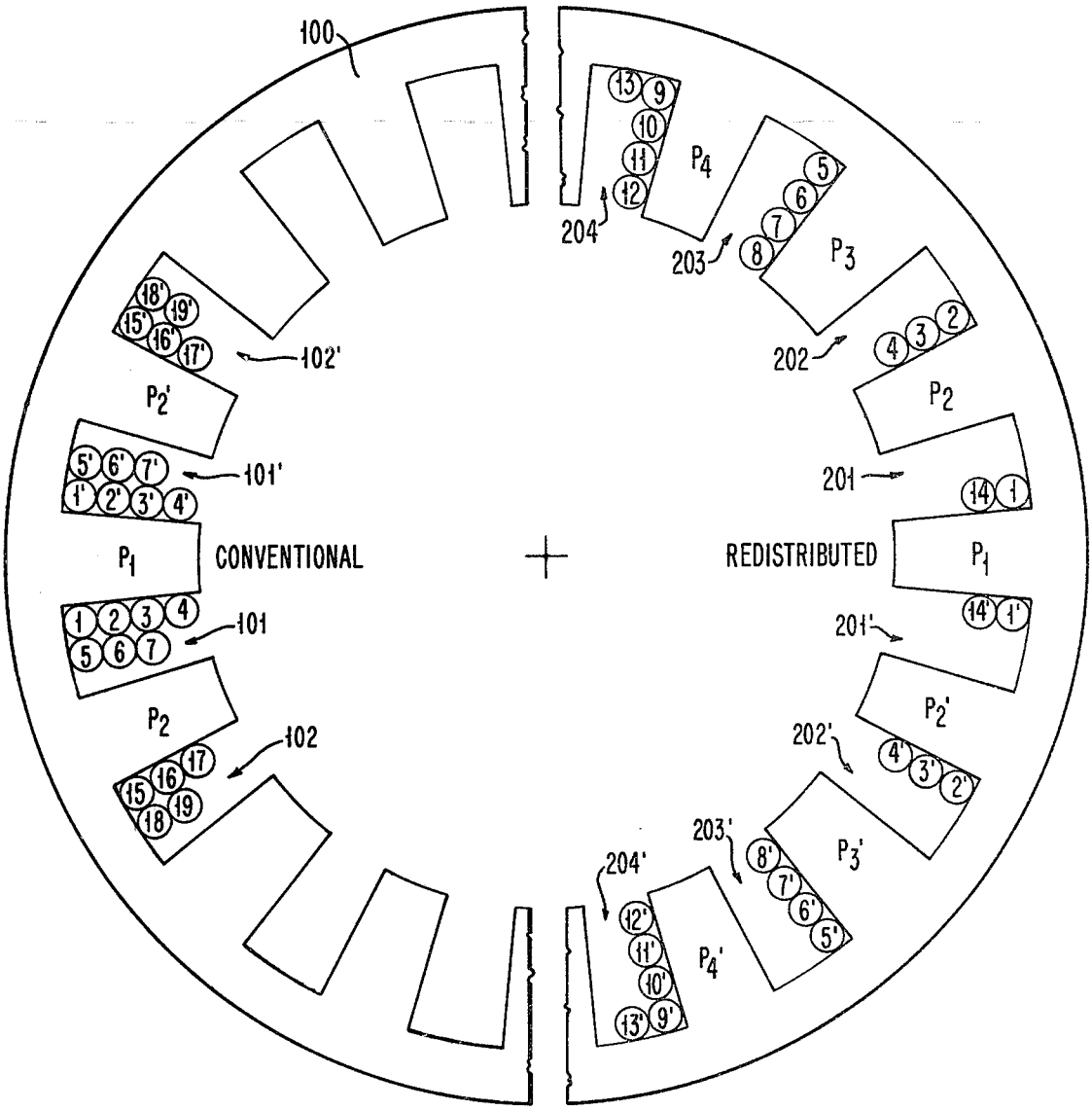
FIG. 10 is a cross section of a rifle barrel type core and showing the manner in which the conductors of one winding are laid in the grooves as compared with a traditional winding.

FIG. 10 depicts a yoke having a core 100 of ferrite or other suitable ferromagnetic material. This core 100 as depicted is the rifle barrel type so called because it has a generally cylindrical exterior and lands and grooves in the interior wall in which the deflection current carrying conductor is laid in turns about the lands which serve as the magnetic pole pieces of the yoke. The figure is greatly enlarged in the interest of clarity; the actual internal diameter is 4 cm. A sixteen pole core is depicted but other cores are equally applicable; thirty two pole cores are frequently used. It should be understood also that those skilled in the art will adapt teaching of the invention in like manner to frustro-conical core pieces and flared core pieces for short barreled, large angle cathode ray tubes.

The core piece 100 of the yoke has a central pole piece for each coil. One coil of a vertical deflection winding has a central pole P1 constituted by the central land that extends in the direction of the axis of the magnetic field to be established. Adjacent pole pieces P2 and $P_2'$, $P_3'$ and $P_3'$, and $P_4$ and $P_4'$ extend radially inward but at an angle to the magnetic field axis. This notation applies to all four sets of pole pieces and to the coils wound thereon.

Each coil of the two, horizontal and vertical deflection, windings is centered about a central pole piece. These central pole pieces are spaced 90° apart around the core 100. Each such central pole piece is coincident with the magnetic field to be established for deflecting an electron beam. As shown only two coils are indicated. The coil at the lefthand side of the yoke depicts a part only of a conventional winding, wherein the turns are laid in each groove in one course. Another similar coil is required at the opposite side of the yoke.

An example of a conventional winding as taken from one of the number of standard specifications data tables which are available to the engineer for the yoke components readily available is set forth in Table I below.

TABLE I

| | Conventional Winding | | | | |
|---|---|---|---|---|---|
| Course | $P_1$ | $P_2$ | $P_3$ | $P_4$ | Total |
| Pole | 14 | 41 | 59 | 70 | 184 |

The data tables call for a total of 184 turns with 14 turns about the central pole $P_1$, 41 turns about the central pole $P_1$ and the two adjacent poles $P_2$ and $P'_2$, 59 turns about the next two poles and including the first three poles and 70 turns about all of the poles in that quadrant. Thus in the two grooves 101 and 101' running along side the first land P1, 14 turns are laid. As each conductor laid in a groove emerges it is crossed over and outwardly from the core piece before entering the next groove whereby the typical saddle coil is formed. Therefore the end portions of the conductor are much farther away from and in a direction normal to the electron beam whereby very little influence is had relative to the very great influence that the elongated conductors within the groove have. Only seven of the 14 turns are indicated in the drawing; the rest are laid in similar fashion. The 42 turns are laid in grooves 102 and 102', of which only five turns are indicated. The winding is finished by laying the remaining conductors in the remaining grooves according to the table I.

On the right hand side of the yoke is a coil laid in the grooves according to the invention. The number of turns in the grooves of the core is not changed by the winding arrangement according to the invention, only the sequence of the turns is modified.

In accordance with the invention, the coil is laid in a number of courses which number is the same as the number of turns about the principle pole from the table (Table I in this example). Thus the distribution winding based on this table is wound in 14 courses. One turn in the first course is laid in the grooves 201, 201' running along side the central land and pole $P_1$. Then three turns are laid in the grooves 202 and 202' which lie adjacent to poles $P_2$ and $P_2'$ and on either side of pole $P_1$ which is included in the poles for the second course followed by four turns in the grooves 203 and 203'. Finally five turns are laid in the grooves 204 and 204' which complete one course of the winding. Now the cycle starts over again exactly as before and 13 more like courses are laid in the grooves. This procedure results in a coil turn distribution according to the Table II below:

TABLE II

| | Distributed Winding | | | | |
|---|---|---|---|---|---|
| Course | $P_1$ | $P_2$ | $P_3$ | $P_4$ | Total |
| 1 | 1 | 3 | 4 | 5 | 16 |
| 2 | 1 | 3 | 4 | 5 | 16 |
| 3 | 1 | 3 | 4 | 5 | 16 |
| 4 | 1 | 3 | 4 | 5 | 16 |
| 5 | 1 | 3 | 4 | 5 | 16 |
| 6 | 1 | 3 | 4 | 5 | 16 |
| 7 | 1 | 3 | 4 | 5 | 16 |
| 8 | 1 | 3 | 4 | 5 | 16 |
| 9 | 1 | 3 | 4 | 5 | 16 |
| 10 | 1 | 3 | 4 | 5 | 16 |
| 11 | 1 | 3 | 4 | 5 | 16 |
| 12 | 1 | 3 | 4 | 5 | 16 |
| 13 | 1 | 3 | 4 | 5 | 16 |
| 14 | 1 | 3 | 4 | 5 | 16 |
| | 14 | 42 | 56 | 70 | 184 |

This results in 192 turns, which number of turns can be reduced by omitting turns in selected courses in such a manner that the distribution of turns is equal to that shown in Table I. In such cases the winding of the various courses are increased by one turn or decreased by one turn at a distribution which provides a very uniform magnetic field. Such a plan is set forth in the Table III below.

TABLE III

| | Distributed 182A | | | | |
|---|---|---|---|---|---|
| Course | $P_1$ | $P_2$ | $P_3$ | $P_4$ | Total |
| 1 | 1 | 3 | 4 | 5 | 13 |
| 2 | 1 | 3 | 4 | 5 | 13 |
| 3 | 1 | 3 | 4 | 5 | 13 |
| 4 | 1 | 3 | $5^2$ | 5 | 14 |
| 5 | 1 | 3 | 4 | 5 | 13 |
| 6 | 1 | 3 | 4 | 5 | 13 |
| 7 | 1 | 3 | 4 | 5 | 13 |
| 8 | 1 | $2^1$ | 4 | 5 | 12 |
| 9 | 1 | 3 | 4 | 5 | 13 |
| 10 | 1 | 3 | $5^2$ | 5 | 14 |
| 11 | 1 | 3 | 4 | 5 | 13 |
| 12 | 1 | 3 | 4 | 5 | 13 |
| 13 | 1 | 3 | $5^2$ | 5 | 14 |
| 14 | 1 | 3 | 4 | 5 | 13 |
| Total | 14 | 41 | 59 | 70 | 184 |
| Difference | | +1 | −3 | | |
| Nominal | 14 | 42 | 56 | 70 | 182 |

In an alternate arrangement which is frequently used, the second and fourth courses are wound in reverse order that is the large number of turns is laid first and then the next smaller number and so forth down to the single turn about the central pole $P_1$. This will permit a tap to be readily located when such is desired. The resulting structure is a winding which as a whole is less lumped and more finely distributed throughout the core.

Figure 11:
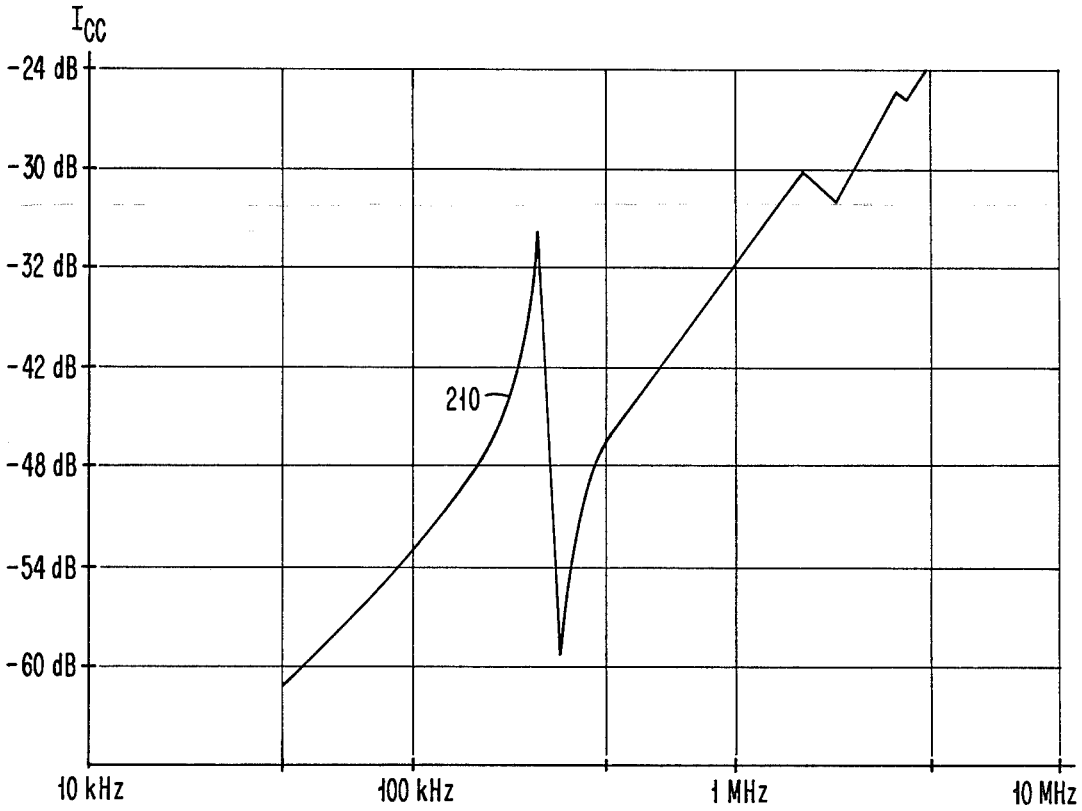
FIG. 11 is a frequency response curve of cross coupling current in accordance with the proposed winding method of the invention.

FIG. 11 is a graphical representation showing the cross coupling current frequency response, curve 210, of a yoke using the winding method according to the invention.

Figure 12:
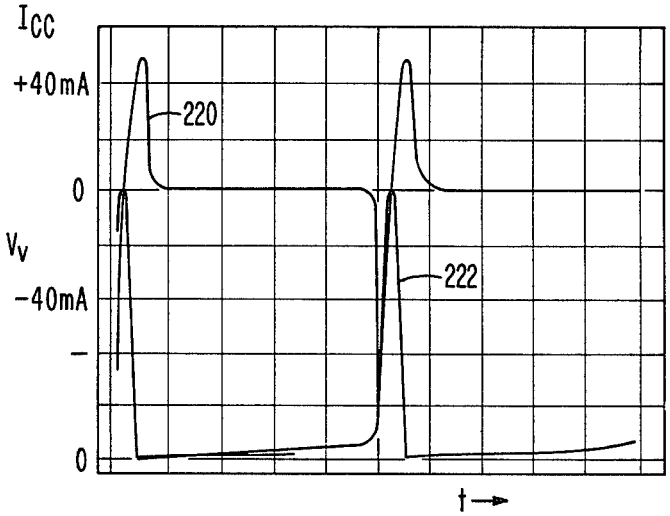
FIG. 12 is a oscilloscopic diagram of cross coupling current obtained with compensation and the winding method according to the invention.

FIG. 12 is a graphical representation of cross coupling current, curve 220, with both compensation and redistributed winding. A curve 222 represents the drive pulse wave in the proper time relation. All of the graphical representations of oscillographic displays are to the same scale.

The effectiveness of this winding method according to the invention lies in the relative smoothness of the winding distribution of the internal courses compared to sole courses which is lump coiled in the traditionally wound yoke. The resulting vertical coil behaves more like a single inductor and not like a high order filter with many resonant peaks and steep slopes. The amount of wire used is almost the same as with the conventional winding.

While the invention has been shown and described with reference to specific embodiments thereof, it should be clearly understood that those skilled in the art will make changes without departing spirit and scope of the invention as defined in the appended claims concluding the specification.

The invention claimed is:

1. An electromagnetic deflection yoke for correcting residual cross coupling distortion, comprising:

a rifle barrel ferromagnetic core having a generally annular cross section for accommodating the neck of cathode ray and like display tubes and having internal grooves and lands running in the general direction of the electron beam in said cathode ray and like display tubes, and a saddle winding of two like diametrically opposed saddle shaped coils each having a continuous elongated conductor laid in said grooves and across the ends of the lands involved in the turns formed thereby, the turns of each of said coils being formed and distributed in a series of courses, the initial course comprising a single turn laid in the grooves defining the central land coincident with the axis of the magnetic field to be established, a succeeding course comprising a plurality of turns laid in the grooves about the next two lands adjacent to and including said central land, a further succeeding course comprising a multiple of turns laid in the next pair of grooves about the two lands adjacent to and encompassing the previously said lands, and so on to the final course comprising the remaining turns laid in the last two grooves and encompassing all of the lands for that coil.

2. An electromagnetic deflection yoke as defined in claim 1, and wherein alternate courses are wound in inverse order to the order of the other courses.

3. An electromagnetic deflection yoke as defined in claim 1 and wherein the number of turns in all courses is substantially the same, but the number of turns in any one course may differ by one turn from all contiguous courses.

4. An electromagnetic deflection yoke for correcting residual cross coupling distortion, comprising a rifle barrel ferromagnetic core having a generally annular cross section for accommodating the neck of cathode ray and like display tubes and having internal grooves and lands running in the general direction of the electron beam in said cathode ray and like display tubes, a saddle winding of two like diametrically opposed saddle shaped coils each having a continuous elongated conductor laid in said grooves and across the ends of the lands involved in the turns formed thereby, and another saddle winding of two coils arranged in said yoke for the complementary direction of deflection, there being stray capacitance established between the two windings, the turns of said coils being formed and distributed in a succession of courses, the first course comprising a single turn laid in the grooves defining the central land coincident with the axis of the magnetic field to be established, a succeeding course comprising a plurality of turns laid in the grooves about the next two lands adjacent to and including said central land, a further succeeding course comprising a multiple of turns laid in the next pair of grooves about the two lands adjacent to and encompassing the previously said lands, and so on to the final course comprising the remaining turns laid in the last two grooves and encompassing all of the lands for that coil, and a pair of capacitors connected in series across the first said winding with the junction between capacitors connected to a center tap on the first said winding, the capacitance of each of said capacitors being equal to one half said stray capacitance between the first said winding and said other winding of the deflection yoke.

5. An electromagnetic deflection yoke as defined in claim 4 and wherein said other winding is a horizontal deflection winding; and the first said winding is a vertical deflection winding.

6. An electromagnetic deflection yoke as defined in claim 1 and incorporating another winding arranged in said yoke for the complementary direction of deflection, a capacitor connected in series with the first said winding and a source of deflection voltage wave, and another capacitor shunted across said source of deflection voltage wave, the sum of the capacitances of said capacitors being equal to the existing capacitance between the first said winding and said other winding of the deflection yoke.

7. An electromagnetic deflection yoke as defined in claim 1 and incorporating another winding arranged in said yoke for the complementary direction of deflection, a capacitor and a resistor connected between a center tap of the first said winding and a point of fixed reference potential.

8. An electromagnetic deflection yoke as defined in claim 7 and wherein the first said winding comprises one portion having a center tap to which said capacitor and said resistor are connected and another portion closely coupled thereto, whereby the impedance of said resistor and capacitor connected to said one portion is reflected into said other portion.

9. An electromagnetic deflection yoke for correcting cross coupling distortion comprising one winding arranged in said yoke for deflection in a given direction, another winding arranged in said yoke for the complementary direction of deflection;

the arrangement of said windings resulting in a capacitor existing therebetween, a capacitor connected in series with said one winding and a source of deflection voltage wave, and another capacitor shunted across said source of deflection voltage wave, the sum of the capacitances of said capacitors being equal to said existing capacitance between said one winding and said other winding of the deflection yoke.

10. An electromagnetic deflection yoke for correcting cross coupling distortion comprising one winding arranged in said yoke for deflection in a given direction, another winding arranged in said yoke for deflection in the complementary direction, the arrangement of said windings resulting in a capacitive reactance existing therebetween, a reactance network connected to said one winding for correcting distortion, said reactance network having at least one capacitance element of value related to the capacitance of said capacitive reactance existing between the one and the other windings.

11. An electromagnetic deflection yoke for correcting cross coupling distortion comprising one winding arranged in said yoke for deflection in a given direction, another winding arranged in said yoke for deflection in the complementary direction, a reactance network connected to said one winding for correcting distortion, and said reactance network having a pair of capacitors connected in series across said one winding with the junction between capacitors connected to a center tap on said one winding, and the capacitance of each of said capacitors being equal to one half the capacitance between said one winding and said other winding of the deflection yoke.

12. An electromagnetic deflection yoke as defined in claim 10, and wherein said one winding is center tapped and said reactance network comprises a capacitor and a resistor connected between said center tap of said one winding and a point of fixed reference potential.

13. An electromagnetic deflection yoke as defined in claim 12 and wherein said one winding comprises one portion having a center tap to which said capacitor and said resistor are connected and another portion closely coupled thereto, whereby the impedance of said resistor and capacitor connected to said one portion is reflected into said other portion.

14. An electromagnetic deflection yoke for correcting residual cross coupling distortion, comprising;

a rifle barrel ferromagnetic core having a generally annular cross section for accommodating the neck of cathode ray and like display tubes and having internal grooves and lands running in the general direction of the electron beam in said cathode ray and like display tubes, and a saddle winding of two like diametrically opposed saddle shaped coils each having a continuous elongated conductor laid in said grooves and across the ends of the lands involved in the turns formed thereby, said turns being formed and distributed in four substantially like sections in each coil with a single turn laid in two grooves about a central land concentric with the axis of the magnetic field to be established, the succeeding three turns laid in the grooves about the two lands adjacent to and including said central land, the succeeding four turns laid in the next pair of grooves about the two lands adjacent to and encompassing the previously said lands, and the remaining turns laid in the last two grooves and encompassing all of the lands for that coil.

15. An electromagnetic deflection yoke for correcting residual cross coupling distortion, comprising:

a rifle barrel ferromagnetic core having a generally annular cross section for accommodating the neck of cathode ray and like display tubes and having internal grooves and lands running in the general direction of the electron beam in said cathode ray and like display tubes, and a saddle winding of two like diametrically opposed saddle shaped coils each having a continuous elongated conductor laid in said grooves and across the ends of the lands involved in the turns formed thereby, the turns of each of said coils being formed and distributed in a succession of courses with the initial course comprising at least one turn of said conductor laid in the grooves defining the central land coincident with the axis of the magnetic field to be established, a succeeding course comprising a number at least greater by one than the number of turns of said conductor in the previous course laid in the grooves about the next two lands adjacent to and including said central land, a further succeeding course comprising a number at least greater by two than the preceding number of turns of said conductor in the preceding course laid in the next pair of grooves about the two lands adjacent to and encompassing the previously said lands, and so on to the final course, the remaining turns of said conductor laid in the next two grooves and encompassing all of the lands for that coil.

16. An electromagnetic deflection yoke as defined in claim 15 and wherein the even numbered courses are wound in inverse order to the order of the odd numbered courses.

* * * * *

UNITED STATES PATENT AND TRADEMARK OFFICE

CERTIFICATE OF CORRECTION

PATENT NO. : 4,232,253

DATED : November 4, 1980

INVENTOR(S) : Joost Mortelmans

It is certified that error appears in the above-identified patent and that said Letters Patent are hereby corrected as shown below:

Column 2, lines 33-35, beginning after "courses." should read as follows:

--A first course comprising a single turn is laid to encompass a central pole for establishing the axis of the magnetic field.--

Column 2, line 40 should read as follows:

--pair of poles encompassing the former poles and finally--

Column 4, line 51 should read as follows:

$$C_1 = [1/(4\pi^2 L_{vp} f_p^{\ 2})] - C_2 \qquad (1)$$

Column 5, line 32 should read as follows:

$$f_p = 1/2\pi [L_{vp}(C_1+C_2)]^{-1/2} \qquad (6)$$

UNITED STATES PATENT AND TRADEMARK OFFICE

CERTIFICATE OF CORRECTION

PATENT NO. : 4,232,253 Page 2 of 2

DATED : November 4, 1980

INVENTOR(S) : Joost Mortelmans

It is certified that error appears in the above-identified patent and that said Letters Patent are hereby corrected as shown below:

Column 5, line 37 should read as follows:

$$f_n = 1/2\pi [L_{vp}(C_1 + \frac{C_2C_3}{C_2 + C_3})]^{-1/2} \qquad (7)$$

Signed and Sealed this

Third Day of March 1981

[SEAL]

Attest:

RENE D. TEGTMEYER

Attesting Officer

Acting Commissioner of Patents and Trademarks